US005732830A

United States Patent [19]

Harrington

[11] Patent Number: 5,732,830

[45] Date of Patent: Mar. 31, 1998

[54] VASE WITH CLAMPING APPARATUS

[75] Inventor: Curtis Craig Harrington, 3630 S. 83rd St., Lincoln, Nebr. 68506

[73] Assignees: Curtis Craig Harrington; Kelly L. Harrington, both of Lincoln, Nebr.

[21] Appl. No.: 682,893

[22] Filed: Jul. 10, 1996

[51] Int. Cl.[6] ..... A47F 5/00

[52] U.S. Cl. ..... 211/4; 211/8; 211/60.1; 70/58; 47/41.01

[58] Field of Search ..... 211/4, 8, 60.1, 211/89; 70/58, 59, 61, 62; 248/553; 47/41.01, 41.11, 41.12, 41.13, 41.14

[56] References Cited

U.S. PATENT DOCUMENTS

| | | | |
|---|---|---|---|
| D. 303,360 | 9/1989 | Levine | D11/144 |
| D. 319,910 | 9/1991 | Hepburn et al. | D99/5 |
| D. 337,077 | 7/1993 | Turley | D11/164 |
| D. 348,235 | 6/1994 | Spahr | D11/164 |
| D. 359,629 | 6/1995 | Korkowski | D6/403 |
| 1,873,693 | 8/1932 | Whitfield et al. | 47/41.11 X |
| 3,961,443 | 6/1976 | Insalaco | 47/32 |
| 4,306,376 | 12/1981 | Strassacker et al. | 47/41.1 |
| 4,395,845 | 8/1983 | Markowitz | 47/32 |
| 4,601,130 | 7/1986 | Du Vall | 47/41.12 |
| 4,616,304 | 10/1986 | Von Kohorn | 362/101 |
| 4,641,755 | 2/1987 | Oliver et al. | 211/8 X |
| 4,860,491 | 8/1989 | Panuski | 47/66 |
| 4,920,693 | 5/1990 | Meade et al. | 47/41.12 |
| 5,184,421 | 2/1993 | Meharg | 47/66 |
| 5,195,270 | 3/1993 | Domurat | 47/41.01 |
| 5,322,254 | 6/1994 | Birkmeier | 248/231.9 |
| 5,375,370 | 12/1994 | Zimmerman | 47/41.01 |
| 5,435,099 | 7/1995 | Conway | 47/66 |
| 5,524,753 | 6/1996 | Murphy | 70/58 X |

*Primary Examiner*—Robert W. Gibson, Jr.

*Attorney, Agent, or Firm*—Zarley, McKee, Thomte, Voorhees & Sease; Mark D. Frederiksen

[57] ABSTRACT

A vase includes a clamping apparatus mounted within the vase body having a pair of jaw members which will selectively clamp together to retain flower stems in position within the vase body. A lock mechanism is mounted on the vase and operable to selectively operate the clamping mechanism to either clamp the flowers in position or release the flowers.

13 Claims, 4 Drawing Sheets

VASE WITH CLAMPING APPARATUS

TECHNICAL FIELD

The present invention relates generally to vases of the type utilized in cemeteries adjacent memorial stones, and more particularly to an improved vase with apparatus therein for gripping and clamping flowers in position within the vase.

BACKGROUND OF THE INVENTION

Flower arrangements are commonplace sites adjacent memorial stones on various occasions. In order to provide a convenient vase for the arrangement and display of such flower arrangements, the prior art discloses various cemetery vases which are stored within a cylindrical sleeve placed in the ground adjacent the memorial stone. The vase is typically stored in the sleeve with the bottom end up, the bottom end having a handle to permit removal of the vase from the sleeve. The vase is then oriented in an upright position and locked in position on the top of the sleeve utilizing a plurality of tabs which are locked within a mounting ring by turning the vase. Normally, a chain or other device is connected between the vase and the mounting ring to prevent theft of the vase.

While the prior art cemetery vases provide a convenient place for displaying flower arrangements, it is still an unfortunate consequence that the flowers are easily blown out of the vase or removed from the vase by theft. This is especially true in the case of artificial flowers, which are intended to remain in the vase for a longer period of time, and are of lighter weight than natural flowers. The cost of such artificial flower arrangements is substantial enough that it would be desirable to provide some apparatus for locking the flowers in position in the vase to prevent them from being easily removed.

SUMMARY OF THE INVENTION

It is therefore a general object of the present invention to provide a vase with a clamping apparatus for locking flower arrangements in place within the vase.

Still another object is to provide a vase with a clamping apparatus which permits selective locking and unlocking of a flower arrangement in the vase.

A further object of the present invention is to provide a cemetery vase with a clamping apparatus which is economical to manufacture, and simple to use.

These and other objects will be apparent to those skilled in the art.

The vase of the present invention includes a clamping apparatus mounted within the vase body having a pair of jaw members which will selectively clamp together to retain flower stems in position within the vase body. A lock mechanism is mounted on the vase and operable to selectively operate the clamping mechanism to either clamp the flowers in position or release the flowers.

DESCRIPTION OF THE PREFERRED EMBODIMENT

Figure 1:
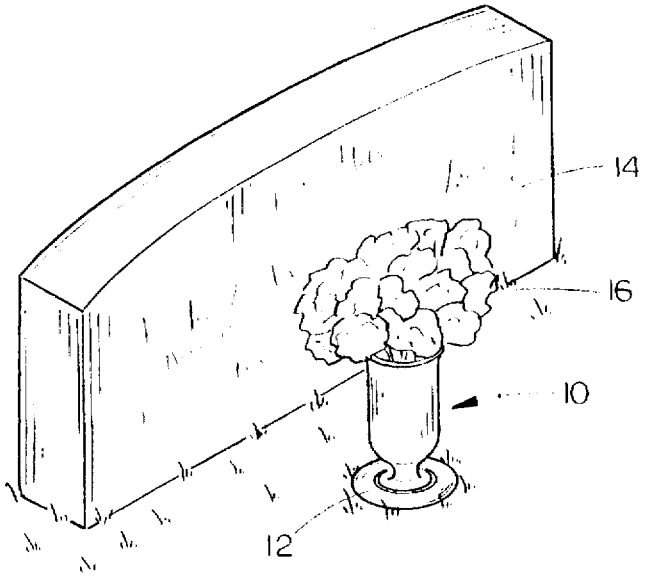
FIG. 1 is a pictorial view of a vase with the clamping apparatus of the present invention installed therein.

Referring now to the drawings, in which similar or corresponding parts are identified with the same reference numeral and more particularly to FIG. 1, the vase of the present invention is designated generally at 10 and is shown connected to a mounting ring 12 on a conventional storage sleeve mounted within the ground adjacent a memorial stone 14. A flower arrangement 16 is shown installed within vase 10 in FIG. 1.

Figure 2:
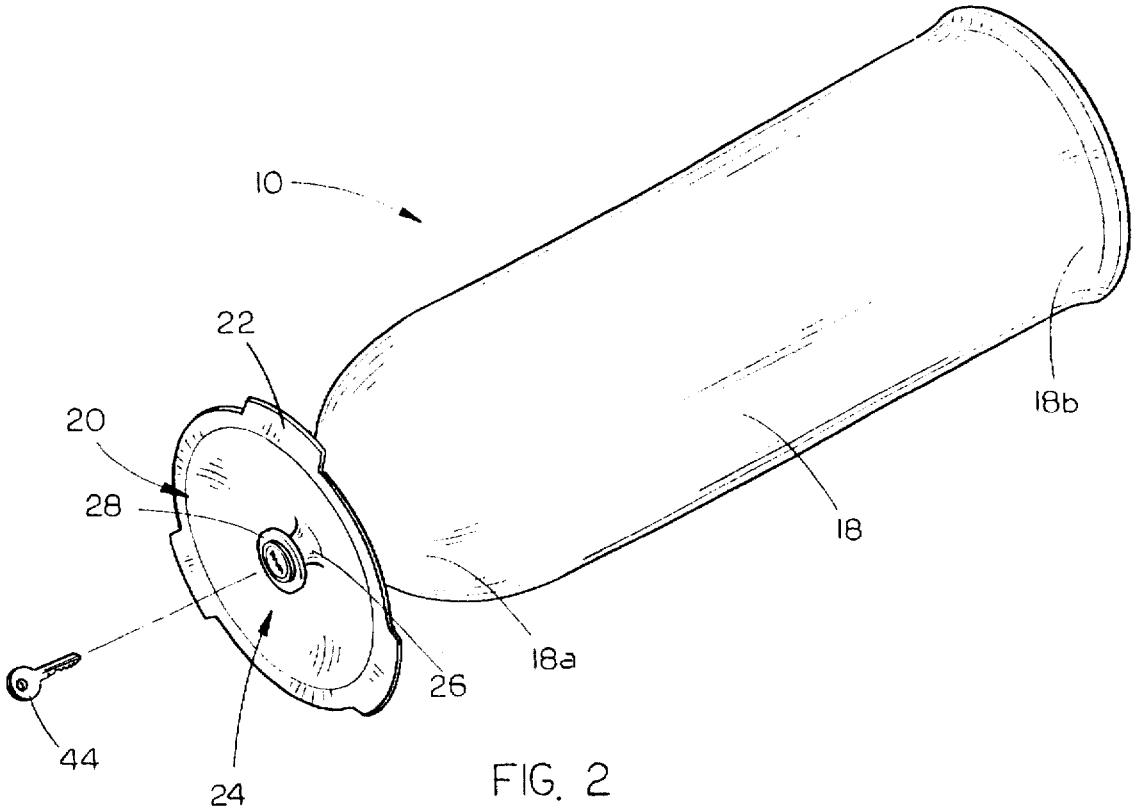
FIG. 2 is an enlarged bottom perspective view of the vase of the present invention.

Referring now to FIG. 2, vase 10 includes an elongated hollow body 18 having a closed lower end **18*a* and an open upper end 18*b*. A base plate 20 is mounted on the lower end 18*a* of body 18 and has projecting flanges 22 thereon which are associated with mounting ring 12 (shown in FIG. 1) to lock the vase in position, in a conventional fashion. A generally cylindrical handle 24 depends from the center of base plate 20 and includes a stem portion 26 and a radially projecting lip 28, permitting the vase to be gripped and removed from the mounting ring 12 (shown in FIG. 1) when the vase is in the storage position with the bottom of base plate 20 oriented upright in mounting ring 12**.

Figure 3:
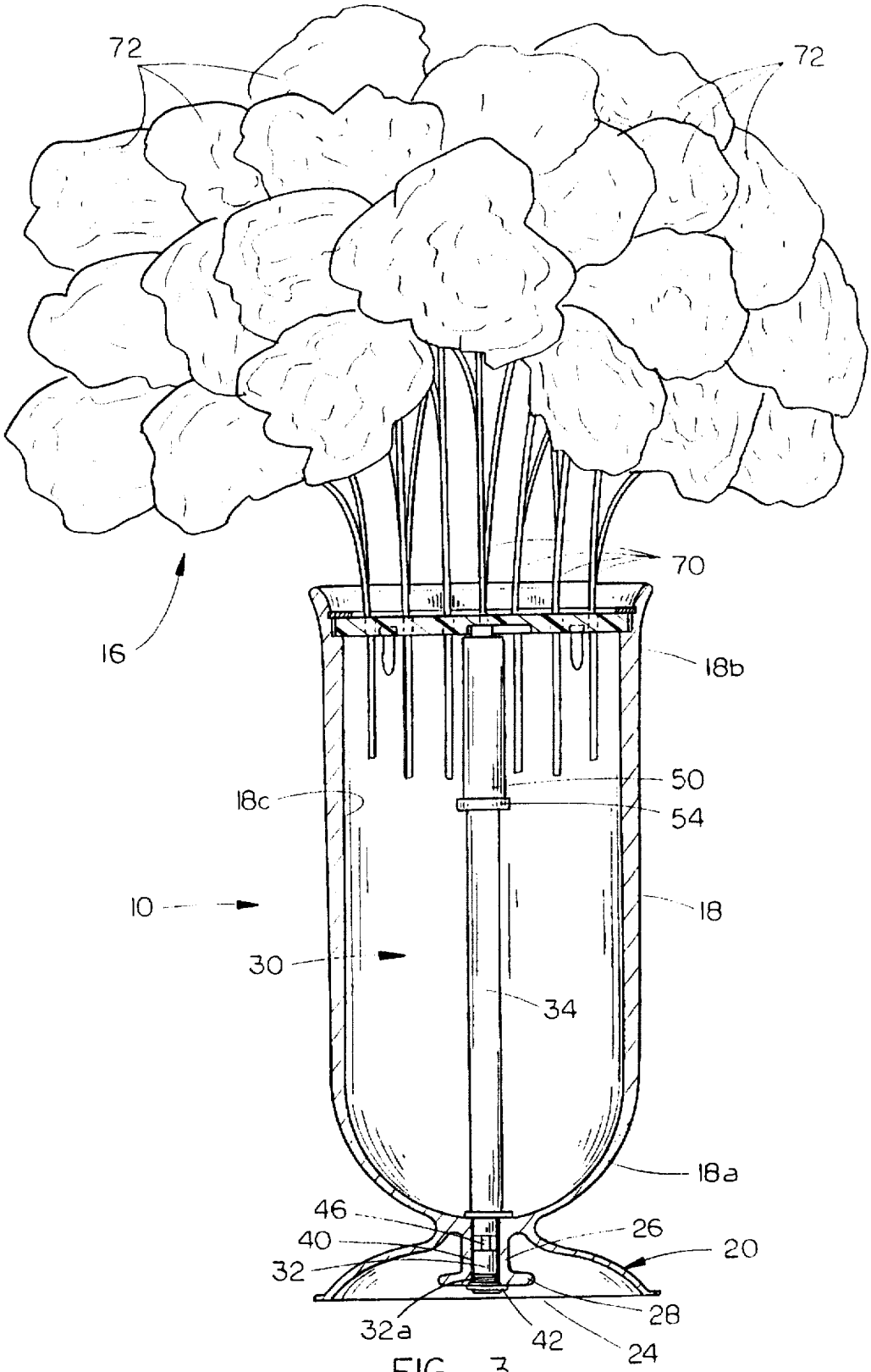
FIG. 3 is a vertical sectional view through the vase of the present invention.
Figure 6:
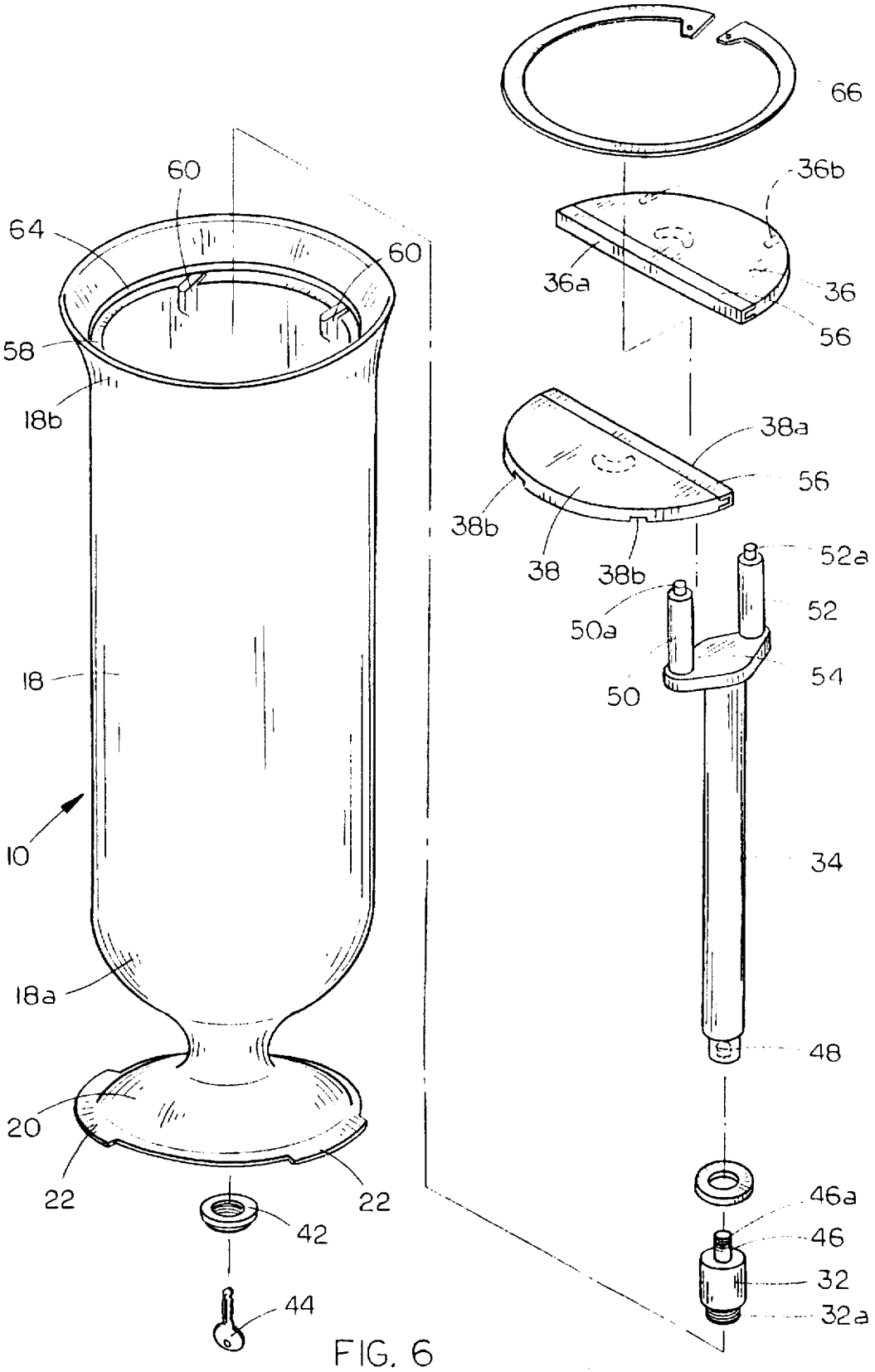
FIG. 6 is an exploded perspective view of the present invention.

Referring now to FIGS. 3 and 6, a clamping apparatus is designated generally at 30 and includes a lock cylinder 32, a drive rod 34, and a pair of operable clamping jaws 36 and 38, as described in more detail hereinbelow. Lock cylinder 32 is journaled into an elongated bore 40 formed in the lower end **18*a* of body 18 and extending along the longitudinal axis of handle 24. A lower threaded end 32*a* projects outwardly from handle 24 and a face plate 42 is threaded thereon to secure lock cylinder 32 in position, and permit entry of a key 44**, in a conventional fashion.

Key cylinder 32 includes an upwardly projecting drive shaft 46 having a threaded upper end **46*a*, which rotates along with the rotation of a key 44 within lock cylinder 32. Drive rod 34 has an interiorly threaded aperture 48 in the lower end thereof which threads onto drive shaft 46 so as to rotate drive rod 34 with the rotation of drive shaft 46. The upper end of drive rod 34 has a pair of upwardly projecting arms 50 and 52 mounted on a plate 54 such that the longitudinal axes of arms 50 and 52 rotate parallel with the longitudinal axis of drive rod 34 as drive rod 34** is rotated.

Each jaw 36 and 38 is preferably a plate having a generally semicircular shape and a flat gripping edge **36*a* and 38*a* respectively. Gripping edges 36*a* and 38*a* have a gripping pad 56 mounted thereon of a resilient material, such as rubber. In this way, when jaws 36 and 38 are brought together such that gripping edges 36*a* and 38*a* are in abutting contact, gripping pads 56** will be in abutting contact, resiliently compressing the stems of flowers therebetween, thereby locking them in position.

An annular horizontal shoulder 58 is formed on the interior surface **18*c* of vase body 18, preferably at the upper end 18*b* thereof. Jaw plates 36 and 38 are sized to rest atop shoulder 58 with their gripping edges 36*a* and 38*a* parallel and adjacent one another. A pair of upwardly projecting guides 60 are formed on shoulder 58 diametric to a second pair of guides 62 (shown in FIGS. 4 and 5) which are arranged to engage corresponding slots 36*b* and 38*b* on the bottom surfaces of jaws 36 and 38. Guides 60 and 62 are oriented orthogonal to gripping pads 56, so as to permit sliding movement of jaws 36 and 38 towards and away from one another such that gripping pads 56** will slide towards and away from one another.

An annular radially directed groove 64 is located spaced above shoulder 58 a distance slightly greater than the thickness of jaw plates 36 and 38, to receive a locking ring 66 therein. Locking ring 66 is of a conventional type which will snap into groove 64 and project radially inwardly therefrom to prevent vertical movement of jaw plates 36 and 38 upwardly off of shoulder 58, while permitting slidable movement of jaw plates 36 and 38.

Figure 4:
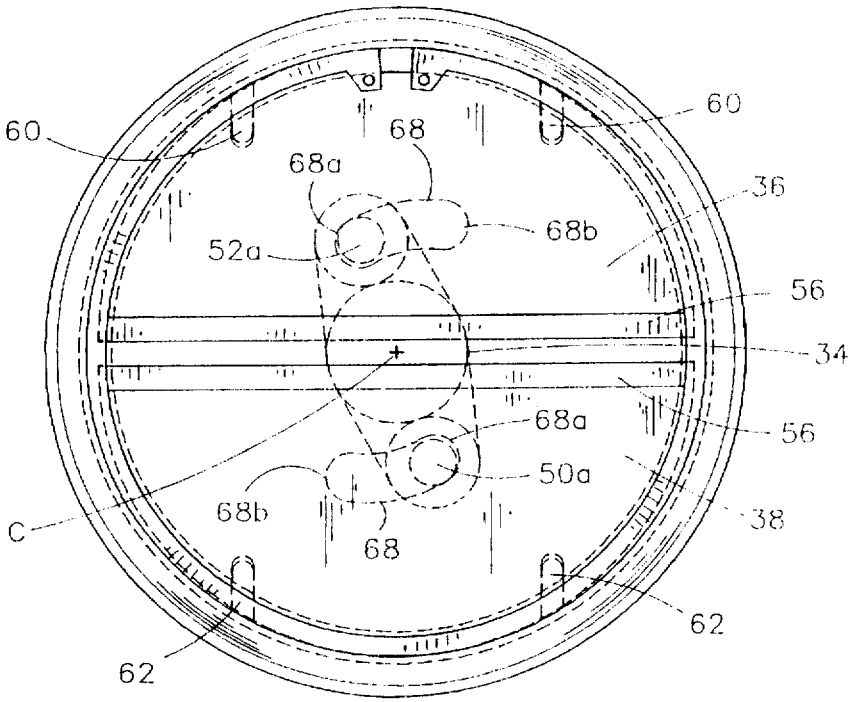
FIG. 4 is a top elevational view of the vase with the clamping apparatus shown in an open position.
Figure 5:
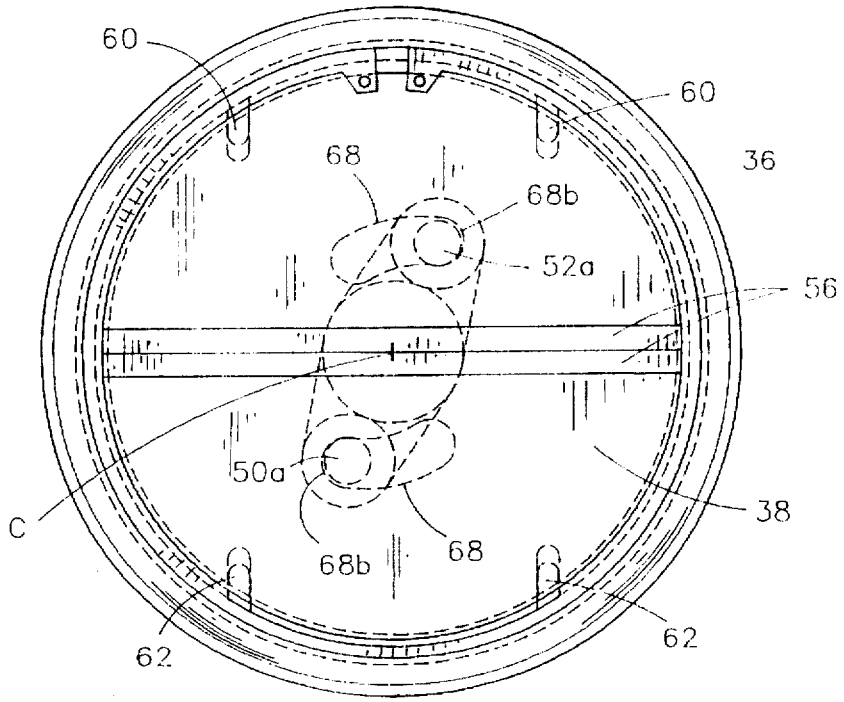
FIG. 5 is a view similar to FIG. 4, with the clamping apparatus in a gripping position.

Referring now to FIGS. 4, 5 and 6, jaw plates 36 and 38 each have an arcuate slot 68 formed therein which will slidably receive an upwardly projecting pin 50*a* and 52*a* of arms 50 and 52 of drive rod 34. Each slot 68 has a first end 68*a* spaced a distance from the longitudinal axis C of drive rod 34 which is less than the distance of the second end 68*b* from axis C. In this way, when pins 50*a* and 52*a* are rotated to slide in slots 68 to the first ends 68*a* of slots 68, jaws 36 and 38 are pushed away from one another along guides 60 and 62, as shown in FIG. 4. As drive rod 34 is rotated in a clockwise direction, to slide pins 50*a* and 52*a* to the second ends 68*b* of slots 68, as shown in FIG. 5, jaws 36 and 38 are drawn towards one another to a closed clamping position.

As shown in FIG. 3, the stems 70 of flowers 72 in flower arrangement 16 are journaled between jaw plates 36 and 38 to project within vase 10. Key 44 is then inserted in lock cylinder 32 and turned, so as to draw gripping pads 56 towards one another to grip and clamp stems 70 therebetween. Key 44 may then be withdrawn from lock cylinder 32 to thereby lock the flowers in position.

Whereas the invention has been shown and described in connection with the preferred embodiment thereof, many modifications, substitutions and additions may be made which are within the intended broad scope of the appended claims.

I claim:

1. A vase for holding flowers and plants with stems, comprising:

an elongated hollow body having a closed lower end and an open upper end;

operable clamp means within said vase, operable to move between a clamped position gripping stems within the vase, and an open position releasing stems within the vase; and means connected to the clamping means for selectively operating the clamp means between the clamped and open positions, including a lock mechanism having a face plate for accessing the lock mechanism to operate the lock mechanism, said face plate mounted exteriorly on the vase.

2. The vase of claim 1, wherein said clamping means includes a pair of first and second jaw plates oriented generally orthogonal to a longitudinal axis of the vase, said jaw plates each having a gripping edge movable towards one another when in the clamped position and away from one another in the open position.

3. The vase of claim 2, further comprising:

a base plate mounted on the lower end of the body, for supporting the vase in an upright position; and a handle depending from a lower surface of the base plate and oriented generally coaxially with the longitudinal axis of the body.

4. The vase of claim 3, wherein said handle has a bore formed therethrough along the axis of the body and extending into the vase body, and wherein said lock mechanism includes a lock cylinder mounted within the bore and the face plate mounted on a bottom of said handle.

5. The vase of claim 4, wherein said jaw plates are operably connected to a drive shaft projecting from the lock cylinder, and operable for movement between the clamped and open positions in response to movement of the lock cylinder drive shaft between locked and unlocked positions, respectively.

6. The vase of claim 1, further comprising:

a base plate mounted on the lower end of the body, for supporting the vase in an upright position; and a handle depending from a lower surface of the base plate and oriented generally coaxially with the longitudinal axis of the body.

7. The vase of claim 6, wherein said handle has a bore formed therethrough along the axis of the body and extending into the vase body, and wherein said lock mechanism includes a lock cylinder mounted within the bore and the face plate mounted on a bottom of said handle.

8. The vase of claim 7, wherein said jaw plates are operably connected to a drive shaft projecting from the lock cylinder, and operable for movement between the clamped and open positions in response to movement of the lock cylinder drive shaft between locked and unlocked positions, respectively.

9. A vase for holding flowers and plants with stems, comprising:

an elongated hollow body having a closed lower end and an open upper end;

operable clamp means within said vase, operable to move between a clamped position gripping stems within the vase, and an open position releasing stems within the vase;

said clamp means including a pair of first and second jaw plates oriented generally orthogonal to a longitudinal axis of the vase, said jaw plates each having a gripping edge movable towards one another when in the clamped position and away from one another in the open position, means connected to the clamping means for selectively operating the clamp means between the clamped and open positions;

a base plate mounted on the lower end of the body, for supporting the vase in an upright position; and a handle depending from a lower surface of the base plate and oriented generally coaxially with the longitudinal axis of the body.

10. The vase of claim 9, wherein said handle has a bore formed therethrough along the axis of the body and extending into the vase body, and wherein said lock mechanism includes a lock cylinder mounted within the bore and the face plate mounted on a bottom of said handle.

11. The vase of claim 10, wherein said jaw plates are operably connected to a drive shaft projecting from the lock cylinder, and operable for movement between the clamped and open positions in response to movement of the lock cylinder drive shaft between locked and unlocked positions, respectively.

12. A vase for holding flowers and plants with stems, comprising:

an elongated hollow body having a closed lower end and an open upper end;

operable clamp means within said body, operable to move between a clamped position gripping stems within the body, and an open position releasing stems within the body;

a base plate mounted on the lower end of the body, for supporting the vase in an upright position; and a handle depending from a lower surface of the base plate and oriented generally coaxially with the longitudinal axis of the body.

13. A vase for holding flowers and plants with stems, comprising:

an elongated hollow body having a closed lower end, an open upper end, the hollow body having an interior cavity for receiving the stems of the flowers and plants;

an operable clamp within the cavity of the body, operable to move between a clamped position gripping the stems, and an open position releasing the stems; and means for selectively operating the clamp means between the clamped and open positions, located within the body cavity and positioned so as to be incapable of operation through the vase upper end.

* * * * *